US009959991B2

(12) United States Patent
Chen

(10) Patent No.: US 9,959,991 B2
(45) Date of Patent: May 1, 2018

(54) KEYSWITCH

(71) Applicant: DARFON ELECTRONICS CORP., Taoyuan (TW)

(72) Inventor: Chi-Hwan Chen, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days. days.

(21) Appl. No.: 15/642,350

(22) Filed: Jul. 6, 2017

(65) Prior Publication Data

US 2018/0019078 A1 Jan. 18, 2018

(30) Foreign Application Priority Data

Jul. 14, 2016 (TW) ..... 105122204 A

(51) Int. Cl.

| | |
|---|---|
| ***H01H 13/52*** | (2006.01) |
| ***H01H 3/12*** | (2006.01) |
| ***H01H 13/10*** | (2006.01) |
| ***H01H 13/14*** | (2006.01) |
| ***H01H 13/04*** | (2006.01) |
| ***H01H 13/02*** | (2006.01) |

(52) U.S. Cl.

CPC ..... *H01H 13/52* (2013.01); *H01H 3/125* (2013.01); *H01H 13/023* (2013.01); *H01H 13/04* (2013.01); *H01H 13/10* (2013.01); *H01H 13/14* (2013.01); *H01H 2013/525* (2013.01)

(58) Field of Classification Search

CPC ..... H01H 13/52; H01H 3/125; H01H 13/023; H01H 13/04; H01H 13/10; H01H 13/14; H01H 2013/525; H01H 9/22; H01H 2217/014; H01H 13/705

USPC ..... 200/314, 341–345, 329, 296, 517, 200/520–521

See application file for complete search history.

(56) References Cited

U.S. PATENT DOCUMENTS

| | | | | |
|---|---|---|---|---|
| 5,424,516 A * | 6/1995 | Emmons | ..... | H01H 3/125 200/341 |
| 6,717,086 B2 * | 4/2004 | Sawyer | ..... | H01H 13/52 200/302.2 |
| 7,772,512 B2 * | 8/2010 | Milo | ..... | E05B 17/22 200/341 |

FOREIGN PATENT DOCUMENTS

| | | |
|---|---|---|
| TW | 225332 | 6/1994 |
| TW | M413953 U1 | 10/2011 |
| TW | M421535 U1 | 1/2012 |

* cited by examiner

*Primary Examiner* — Edwin A. Leon
(74) *Attorney, Agent, or Firm* — Winston Hsu

(57) ABSTRACT

A keyswitch uses a magnetic attraction force produced between and by a fixed part, fixedly disposed relative to a base, and a movable part, movably disposed relative to the base, as a driving force for returning a keycap to its original position. The movable part is between the fixed part and the base. The keyswitch also uses a force transmission part disposed between the keycap and the movable part as an intermediate for transferring force from the keycap to the movable part. When a force for pressing the keycap downward overcomes the magnetic attraction force, the movable part moves toward the base and then triggers a switch.

17 Claims, 15 Drawing Sheets

KEYSWITCH

BACKGROUND OF THE INVENTION

1. Field of the Invention

The invention relates to a keyswitch, and especially relates to a keyswitch using a magnetic attraction force as a driving force for restoring the keycap of the keyswitch.

2. Description of the Prior Art

Conventional keyswitches use an elastic rubber dome for producing a driving force for restoring the keycap. The elastic rubber dome is also used for providing pressing feeling (or force feedback) to a user. When the keyswitch is reduced in volume (e.g. the height thereof is decreased), a space for disposing the elastic rubber dome is also reduced so that the driving force provided by the elastic rubber dome to the keycap is limited and the operation stability of the elastic rubber dome is reduced accordingly. A small or unstable driving force will induce a poor pressing feeling for the user. For example, the use may be hardly aware that the keycap has been pressed effectively. In addition, there is a kind of keyswitches using magnetic attraction force as a driving force for restoring the keycap. The keyswitch can use a magnet with larger magnetism so as to provide the user an enough and stable reaction force through the keycap within a limited pressing displacement of the keycap. However, the components for providing the magnetic attraction force are usually disposed on a lift mechanism which provides the keycap up and down movement, so the reaction force induced by the magnetic attraction force is transferred to the keycap through the lift mechanism and is then received by the user through the keycap. The transfer path of the reaction force passes through more components and has more turns. The connections and relative movements of these components also involve other forces. The above features make the reaction force unstable to the user.

SUMMARY OF THE INVENTION

An objective of the invention is to provide a keyswitch. The keyswitch uses an interaction between a magnetic attraction force and a force transmission part for providing a displacement buffer of a keycap of the keyswitch to a user who is pressing the keycap.

A keyswitch according to the invention includes abase, a keycap, a lift mechanism, a fixed part, a movable part, and a force transmission part. The base includes a switch and a connection structure. The lift mechanism is connected to and between the connection structure and the keycap. The keycap is movable parallel to a movement direction relative to the base through the lift mechanism between an un-pressed position and a pressed position. The fixed part is disposed fixedly relative to the base between the base and the keycap. The fixed part has a first magnetic portion. The movable part is disposed movably relative to the base between the base and the fixed part. The movable part has a second magnetic portion and a trigger portion. A magnetic attraction force due to a magnetic attraction effect between the first magnetic portion and the second magnetic portion is exerted on the movable part. A direction of the magnetic attraction force points toward the first magnetic portion. The trigger portion and the switch are disposed oppositely. The trigger portion triggers the switch when the keycap is located at the pressed position. The force transmission part is connected to and between the keycap and the movable part. When the keycap moves from the un-pressed position toward the pressed position, the keycap moves the movable part downward through the force transmission part to make the trigger portion triggers the switch. Thereby, the reaction force induced by the magnetic attraction force is transferred to the keycap through the force transmission part and is then received by the user. The disposition of the above components provides a direct transfer path, so that the reaction force (or force feedback) received by the user through the keycap is stable.

Compared with the prior art, the keyswitch according to the invention uses the force transmission part as an intermediate for transferring force from the keycap to the movable part, which can provide the user with a direct and stable reaction force (or force feedback) and a clear pressing feeling as well.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
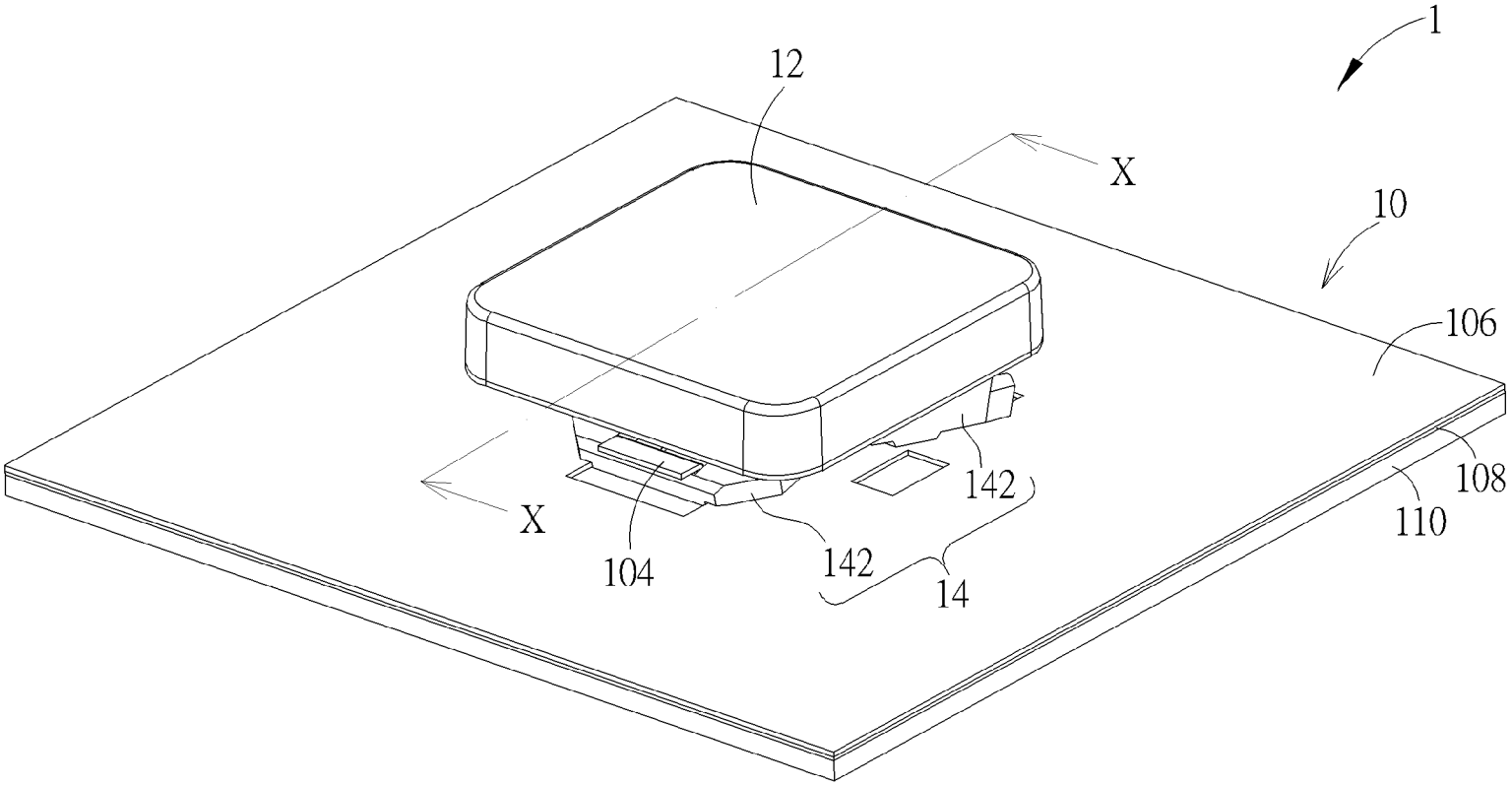
FIG. 1 is a schematic diagram illustrating a keyswitch of an embodiment according to the invention.
Figure 2:
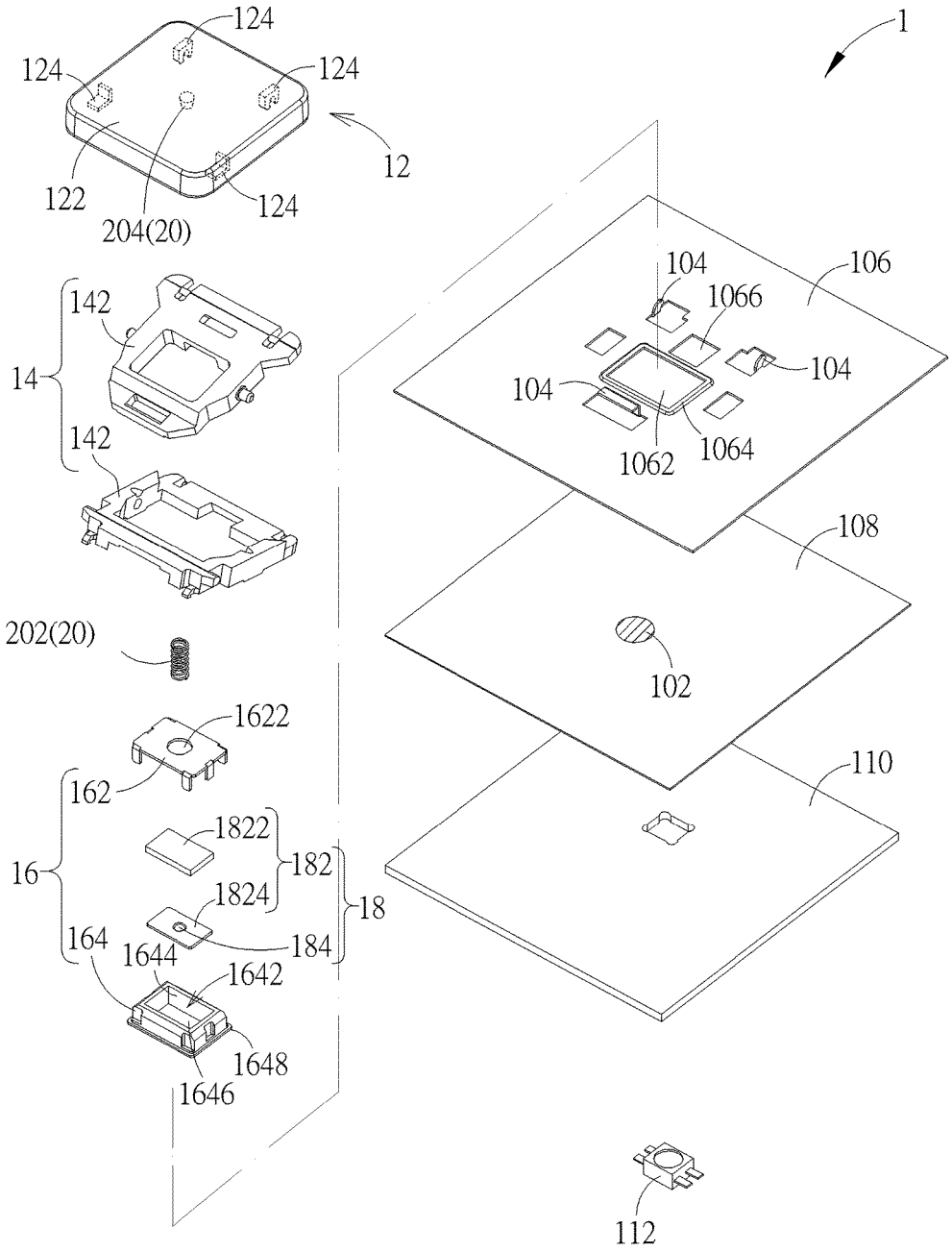
FIG. 2 is an exploded view of the keyswitch in FIG. 1.

Please refer to FIG. 1 to FIG. 5. A keyswitch 1 of an embodiment according to the invention includes a base 10, a keycap 12, a lift mechanism 14, a fixed part 16, a movable part 18, and a force transmission part 20. The base 10 includes a switch 102 (shown by a circle with hatched lines in FIG. 2) and a connection structure 104. The keycap 12 is disposed above the base 10. The keycap 12 includes a cap body 122 and a connection structure 124 (shown in dashed lines in FIG. 2) disposed on a bottom surface 1222 of the cap body 122. The lift mechanism 14 is connected to and between the connection structure 104 of the base 10 and the connection structure 124 of the keycap 12, so that the keycap 12 can move parallel to a movement direction Dl (indicated by a line segment with two arrows in the figures) relative to the base 10 through the lift mechanism 14 between an un-pressed position (shown by the location of the keycap 12 in FIG. 3 relative to the base 10) and a pressed position (shown by the location of the keycap 12 in FIG. 5 relative to the base 10). The fixed part 16 is disposed fixedly relative to the base 10 between the base 10 and the keycap 12. The fixed part 16 has a first magnetic portion 162. The movable part 18 is disposed movably relative to the base 10 between the base 10 and the fixed part 16. The movable part 18 has a second magnetic portion 182 and a trigger portion 184. A magnetic attraction effect occurs between the first magnetic portion 162 and the second magnetic portion 182. The magnetic attraction effect induces a magnetic attraction force F1 exerted on the movable part 18 (or the second magnetic portion 182). The direction of the magnetic attraction force F1 points toward the first magnetic portion 162 of the fixed part 16. The trigger portion 184 and the switch 102 are disposed oppositely. When the keycap 12 is located at the pressed position, the trigger portion 184 triggers the switch 102. Two ends of the force transmission part 20 are connected to and between the movable part 18 and the bottom surface 1222 of the cap body 122. When the keycap 12 moves from the un-pressed position toward the pressed position, the keycap 12 moves the movable part 18 downward through the force transmission part 20 (i.e. making the movable part 18 move toward the base 10), so as to make the trigger portion 184 triggers the switch 102. In the embodiment, the force transmission part 20 includes a spring 202 and a guiding post 204. An upper end of the spring 202 abuts against the bottom surface 1222 of the cap body 122. A lower end of the spring 202 abuts against the movable part 18. The guiding post 204 extends from the bottom surface 1222 of the cap body 122 toward the movable part 18 and inserts into the spring 202. In practice, the guiding post 204 and the cap body 122 can be formed in a single structure. In the embodiment, the spring 202 is a helical spring surrounding the guiding post 204, so the guiding post 204 can guide deformation of the spring 202, enhance the stability and reliability of elastic deformation of the spring 202, and is also conducive to positioning the spring 202 relative to the cap body 122. When the keycap 12 moves from the un-pressed position toward the base 10, the spring 202 is elastically compressed by the keycap 12 and the movable part 18 to exert a restoring force F2 on the movable part 18. The direction of the restoring force F2 points toward the base 10. In practice, the restoring force F2 is equivalent to the restoration force of the compressed spring 202.

Figure 3:
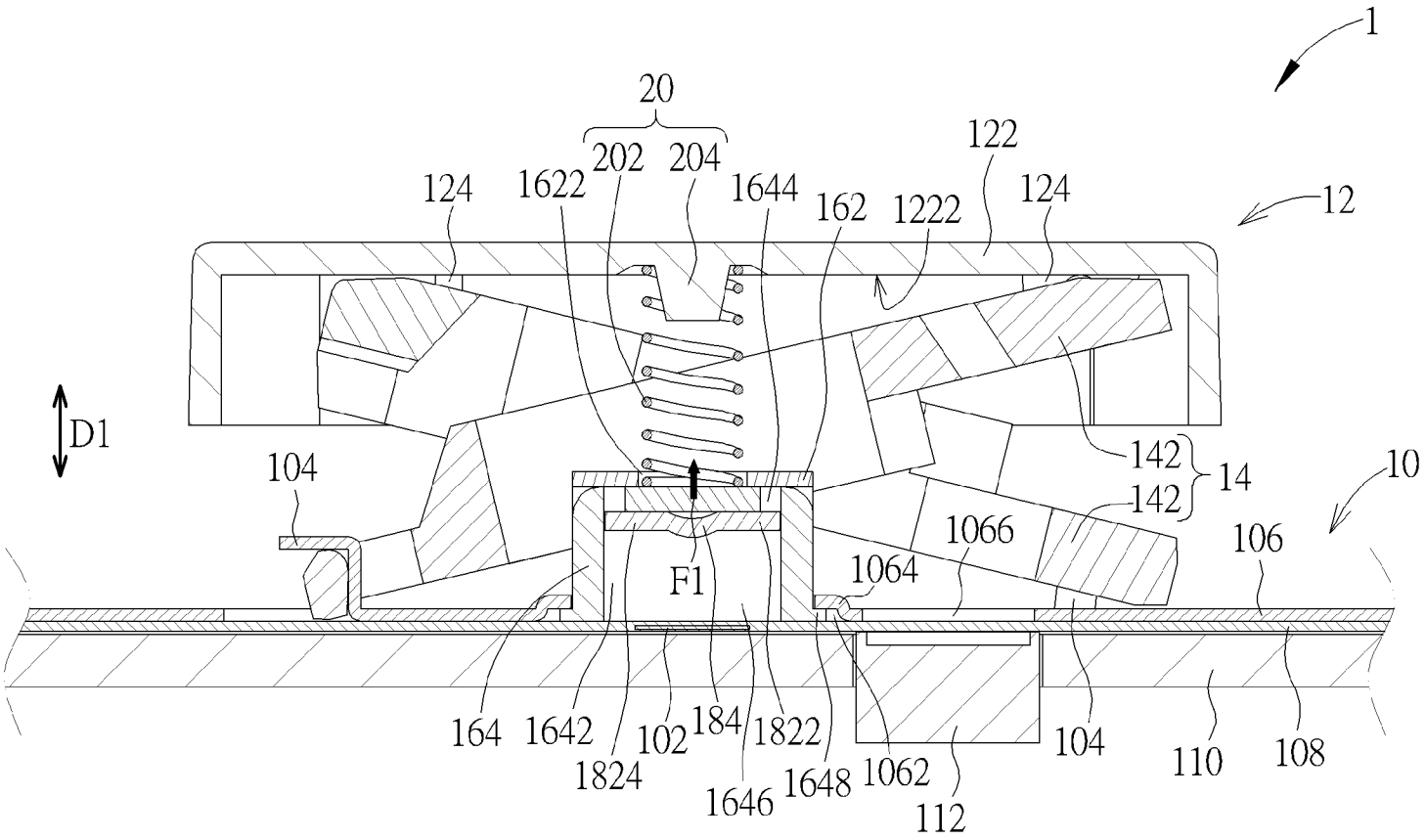
FIG. 3 is a sectional view of the keyswitch in FIG. 1 along the line X-X.
Figure 4:
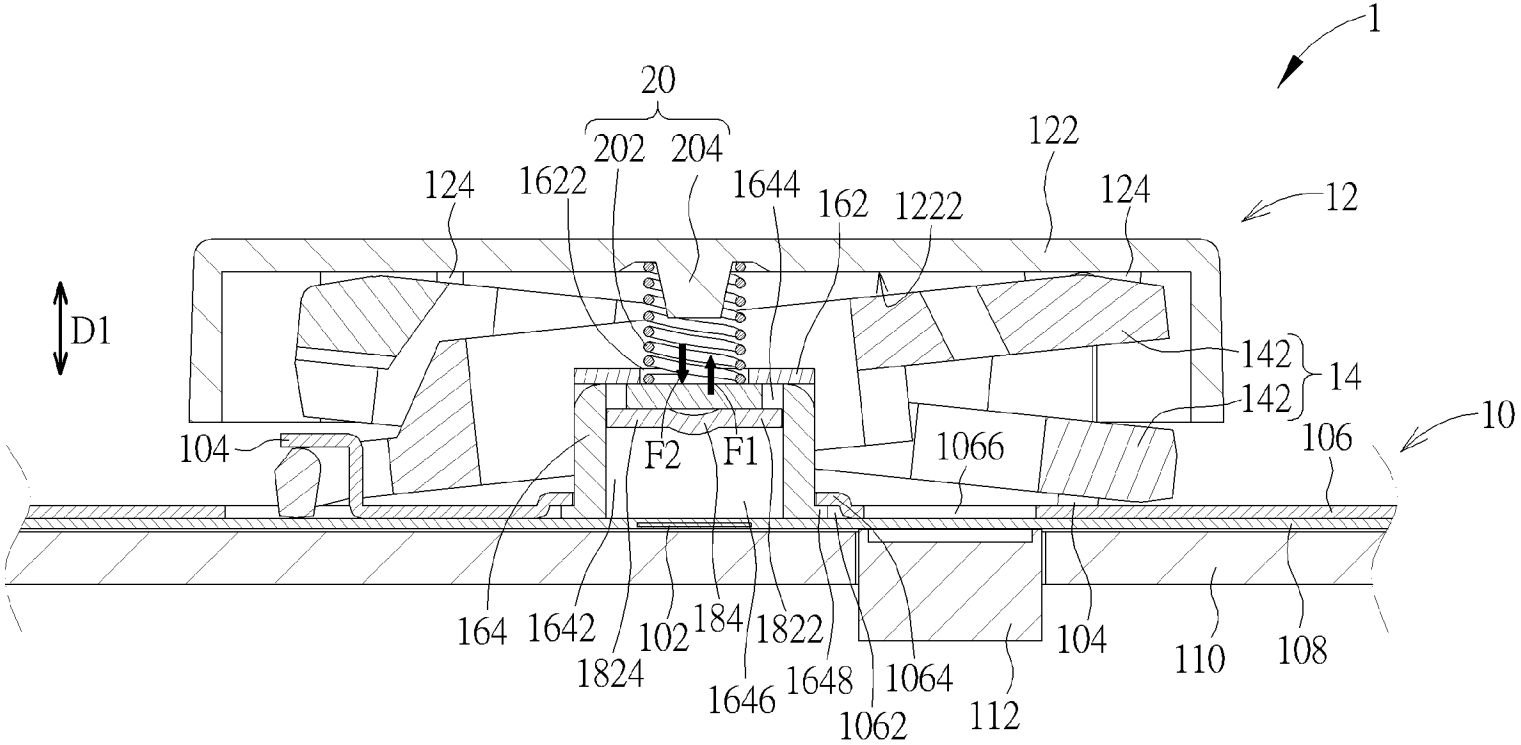
FIG. 4 is a sectional view of the keyswitch in FIG. 3 when a keycap thereof is pressed partially.
Figure 5:
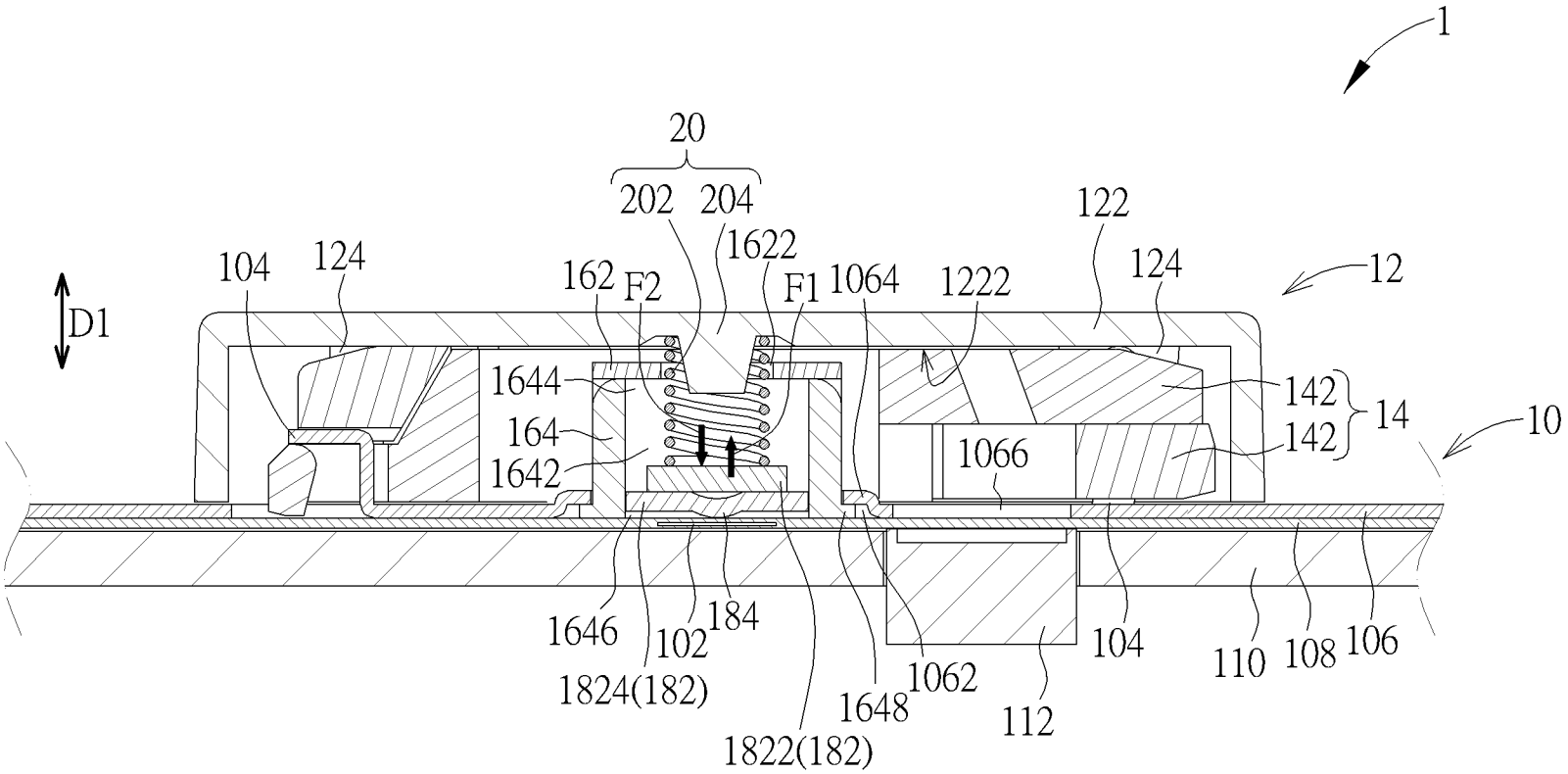
FIG. 5 is a sectional view of the keyswitch in FIG. 3 when the keycap thereof is pressed completely.

As shown by FIG. 5, in the embodiment, when the keycap 12 is located at the pressed position, the spring 202 is not compressed to be solid yet. In principle, without consideration to the gravity of the components and the friction produced by relative movements between the components, whether the movable part 18 moves toward the base 10 depends on the resultant force of the magnetic attraction force F1 and the restoring force F2. When the keycap 12 is located at the un-pressed position (as shown by FIG. 3), the spring 202 is not compressed or the compression deformation of the spring 202 reaches a minimum, so the magnitude of the restoring force F2 is zero or reaches a minimum. In FIG. 3, the restoring force F2 is assumed to be zero and is not shown in the figure accordingly. At this moment, the magnetic attraction force F1 is larger than the restoring force F2. The resultant force of the magnetic attraction force F1 and the restoring force F2 makes the movable part 18 remain stationary relative to the base 10. When the keycap 12 is pressed by the user to move from the un-pressed position toward the base 10 to an intermediate position (shown by the location of the keycap 12 in FIG. 4 relative to the base 10, between the un-pressed position and the pressed position), the restoring force F2 increases to be in equilibrium with the magnetic attraction force F1 as the keycap 12 moves; that is, the restoring force F2 overcomes the constraint of the magnetic attraction force F1 on the movement of the movable part 18 relative to the base 10. In the embodiment, the restoring force F2 and the magnetic attraction force F1 are parallel to the movement direction Dl, so the resultant force of the magnetic attraction force F1 and the restoring force F2 is zero at this moment. Therefore, if the keycap 12 proceeds with moving toward the base 10 (e.g. by the user continuing pressing the keycap 12), the keycap 12 moves the movable part 18 toward the base 10 through the force transmission part 20 (or the spring 202). Therein, the intermediate position can be designed to be a position where the base 10 is located when the movable part 18 starts moving toward the base 10. Afterward, when the keycap 12 continues moving from the intermediate position to the pressed position, the trigger portion 184 triggers the switch 102, as shown by FIG. 5.

Furthermore, during the movement of the keycap 12 from the intermediate position to the pressed position, the magnitude of the magnetic attraction force F1 decreases as the second magnetic portion 182 of the movable part 18 moves away from the first magnetic portion 162 of the fixed part 16; in principle, the magnitude of the restoring force F2 also decreases. For example, the movement of the movable part 18 toward the base 10 is assumed to be a constant speed motion. During the movement, the magnitudes of the restoring force F2 and the magnetic attraction force F1 are the same. In the embodiment, when the keycap 12 is located between the un-pressed position and the intermediate position, the distance between the first magnetic portion 162 and the second magnetic portion 182 reaches a minimum, and the magnetic attraction force F1 reaches a maximum. Therefore, for an operation of the user pressing the keycap 12 to trigger the switch 102, during the movement of the keycap 12 from the un-pressed position to the intermediate position, the magnitude of the restoring force F2 gradually increases from its minimum (i.e. when the keycap 12 is located at the un-pressed position) to be equal to the magnitude of the magnetic attraction force F1 (or the maximum of the magnetic attraction force F1). During the movement of the keycap 12 from the intermediate position to the pressed position, the magnitudes of the restoring force F2 and the magnetic attraction force F1 are equal and decrease. Furthermore, in the embodiment, it is assumed that when the user operates the keyswitch 1, the keycap 12 receives only the force exerted thereon by the user and the reaction force exerted thereon by the spring 202, so the force feedback (or the reaction force exerted on the user by the keycap 12) received by the user when the user presses the keycap 12 is equal to the restoring force F2. Therefore, when pressing the keycap 12 to trigger the switch 102, the user can feel a clear peak of the force feedback (i.e. at the time when the restoring force F2 is equal to the maximum of the magnetic attraction force F1, or at the time when the keycap 12 moves downward to the intermediate position) and also can feel a pressing displacement buffer (i.e. the distance between the un-pressed position and the intermediate position) before the force feedback reaches the peak. Therefore, the keyswitch 1 can provide the user with a clear pressing feeling.

Furthermore, when the user's finger moves away from the keycap 12 located at the pressed position, the spring 202 springs back rapidly. The movable part 18 is driven by the magnetic attraction force F1 to move upward and simultaneously moves the keycap 12 upward through the spring 202 until the distance between the first magnetic portion 162 and the second magnetic portion 182 reaches the minimum and the keycap 12 returns to the un-pressed position. Furthermore, in the embodiment, the user can feel the interaction between the magnetic attraction force F1 and the restoring force F2 directly through the keycap 12 and the force transmission part 20, so that the feeling of the user pressing the keycap 12 (i.e. the reaction force received by the user) can directly reflect the interaction between the magnetic attraction force F1 and the restoring force F2. Therefore, the reaction force (or force feedback) received by the user through the keycap 12 is stable.

In addition, in the embodiment, the lift mechanism 14 is realized by a scissors structure and includes two supports 142 cross connected with each other. Each support 142 is connected to the connection structure 124 of the keycap 12 and the connection structure 104 of the base 10, so that the supports 142 provides the keycap 12 with an up and down movement relative to the base 10 (i.e. parallel to the movement direction Dl). In practice, the lift mechanism 14 can be replaced with other mechanisms capable of providing an up and down movement to the keycap 12, e.g. two separate supports disposed oppositely and two annular members sleeved with each other. Furthermore, in the embodiment, the movement direction Dl is a vertical direction relative to the base 10, but the invention is not limited thereto. For example, in practice, the keycap 12 can obliquely move relative to the base 10 by using a different lift mechanism. In addition, in the embodiment, the base 10 includes a base plate 106 and a circuit board 108. The base plate 106 is disposed between the circuit board 108 and the lift mechanism 14. The connection structure 104 is disposed on the base plate 106. In the embodiment, the connection structure 104 and the base plate 106 are formed in a single structure, e.g. by a pressing process on a metal sheet. The switch 102 is disposed on the circuit board 108. In the embodiment, the circuit board 108 is a membrane circuit board. The switch 102 is formed in the membrane circuit board by a circuit printing way. The base plate 106 is stacked on the circuit board 108 and has a first through hole 1062. The first through hole 1062 is aligned with the switch 102 so that the switch 102 is exposed out through the first through hole 1062.

For more details, in the embodiment, the fixed part 16 includes a casing 164. The casing 164 is fixed on the base 10 and has an accommodating space 1642 and a first opening 1644. The first opening 1644 is connected with the accommodating space 1642. The first magnetic portion 162 is fixed on the casing 164. The movable part 18 is movably disposed in the accommodating space 1642. The spring 202 of the force transmission part 20 extends into the accommodating space 1642 through the first opening 1644. Furthermore, in the embodiment, the whole movable part 18 is disposed in the accommodating space 1642. The casing 164 also has a second opening 1646. The second opening 1646 is connected with the accommodating space 1642 and is aligned with the first through hole 1062 of the base plate 106, so that the switch 102 is exposed out in the accommodating space 1642 through the first through hole 1062 and the second opening 1646 so that when the keycap 12 is located at the pressed position, the trigger portion 184 of the movable part 18 can touch the switch 102. Furthermore, in the embodiment, the casing 164 is fixed on the base 10 by engaging a flange 1648 disposed at the second opening 1646 with a flange 1064 formed at the first through hole 1062. Further, an engagement slot is formed between the flange 1064 and the circuit board 108, which is conducive to the engagement of the flange 1648 of the casing 164 with the flange 1064 of the base plate 106. However, the invention is not limited thereto. For example, the casing 164 can be glued directly onto the base plate 106, or the casing 164 and the base plate 106 can be structurally integrated, e.g. by an injection molding of non-magnetic material (e.g. engineering plastic).

Furthermore, in the embodiment, the casing 164 as a whole substantially shows a tubular or annular structure and extends vertically. The first opening 1644 and the second opening 1646 are located at the two opposite ends. The first magnetic portion 162 is disposed at the first opening 1644 and has a second through hole 1622. The spring 202 of the force transmission part 20 extends into the accommodating space 1642 through the second through hole 1622 and the first opening 1644. Therefore, under the interaction between the magnetic attraction force F1 and the restoring force F2, the movable part 18 moves vertically in the accommodating space 1642. Therein, the casing 164 can guide the movement of the movable part 18. In the embodiment, the first magnetic portion 162 is engaged with the edge structure of the first opening 1644 and substantially seals the first opening 1644, so that the accommodating space 1642 is connected with the outside of the casing 164 through the second through hole 1622 of the first magnetic portion 162. In addition, in the embodiment, the movable part 18 includes a magnet 1822 and a paramagnetic plate 1824 (e.g. a ferroalloy plate). The paramagnetic plate 1824 is magnetically attached (or adheres) onto the magnet 1822 and is located between the magnet 1822 and the base 10 (or the base plate 106). The second magnetic portion 182 is formed by the magnet 1822 and the paramagnetic plate 1824. This structural configuration can increase the whole thickness of the movable part 18 so as to enhance the stability of the up and down movement of the movable part 18 and the strength of the magnetic field produced by the second magnetic portion 182 and the first magnetic portion 162. The paramagnetic plate 1824 can increase the structural complexity of the movable part 18 (e.g. by using the paramagnetic plate 1824 to form the required structure, e.g. the trigger portion 184 that will be described in the following, for the movable part 18). The trigger portion 184 is disposed on the paramagnetic plate 1824 and protrudes toward the base 10; in practice, the trigger portion 184 and the paramagnetic plate 1824 can be integrated into a single structure by pressing a ferroalloy plate. Correspondingly, the first magnetic portion 162 can be a paramagnetic plate or a magnet (of which the magnetic pole toward the second magnetic portion 182 is opposite to the magnet 1822 of the second magnetic portion 182 toward the first magnetic portion 162), so that the first magnetic portion 162 and the second magnetic portion 182 can produce the magnetic attraction effect therebetween. In addition, in practice, possible mechanisms capable of producing the magnetic attraction effect between the first magnetic portion 162 and the second magnetic portion 182 are not limited to the above structural configuration. For example, the first magnetic portion 162 is a paramagnetic part or a magnet and the second magnetic portion 182 is a magnet or a paramagnetic part accordingly, which can produce the magnetic attraction effect therebetween. For another example, the first magnetic portion 162 and the second magnetic portion 182 are magnets with opposite magnetic poles, which also can produce the magnetic attraction effect therebetween.

In addition, in the embodiment, the base 10 further includes another circuit board 110 and a lighting part 112 (for example but not limited to an LED) disposed on the circuit board 110. The circuit board 108 is stacked on the circuit board 110; that is, the circuit board 108 is located between the base plate 106 and the circuit board 110. In the embodiment, the circuit board 110 is a printed circuit board on which the lighting part 112 is electrically connected. In general, compared with printed circuit boards, the membrane circuit board is relatively flexible and is usually used in keyboards. The membrane circuit board is of a sandwich structure which includes an upper substrate layer, a lower substrate layer disposed opposite to the upper substrate layer, and an insulation layer disposed therebetween. The upper substrate layer and the lower substrate layer thereon form circuitry. The insulation layer has through holes, of which each is located at one pair of contacts of the circuitry. The upper substrate layer, the lower substrate layer, and the insulation layer are usually made of transparent polymer material. For simplification of the figures, the sandwich structure of the circuit board 108 in the embodiment is not shown in the figures. In the embodiment, the circuit board 108 is clamped between the base 10 and the circuit board 110, which has an effect of fixing the circuit board 108. The base plate 106 further has a window 1066 disposed opposite to the lighting part 112, so that the lighting part 112 can be optically exposed out through the window 1066 (i.e. light can pass through the circuit board 108 and emit out through the window 1066). If the circuit board 108 also has a through hole opposite to the lighting part 112, the lighting part 112 can be structurally exposed out through the window 1066 (i.e. the lighting part 112 is touchable through the window 1066). In the embodiment, the lighting part 112 can emit light toward the keycap 12, e.g. as backlight for the keycap 12, so the keyswitch 1 can be taken as an illuminated keyswitch. In addition, in logic, the circuit boards 108 and 110 can be taken as a single circuit board (a circuit board combination). In practice, the circuit boards 108 and 110 can be structurally integrated. For example, the circuit board 110 also can be taken as a substrate layer of the circuit board 108 (a membrane circuit board). For another example, the lighting part 112 is changed to be connected onto the circuit board 108, and the circuit board 110 can be omitted accordingly. For another example, switch 102 is realized by a touch switch and is changed to be connected onto the circuit board 110, and the circuit board 108 is omitted accordingly.

Figure 6:
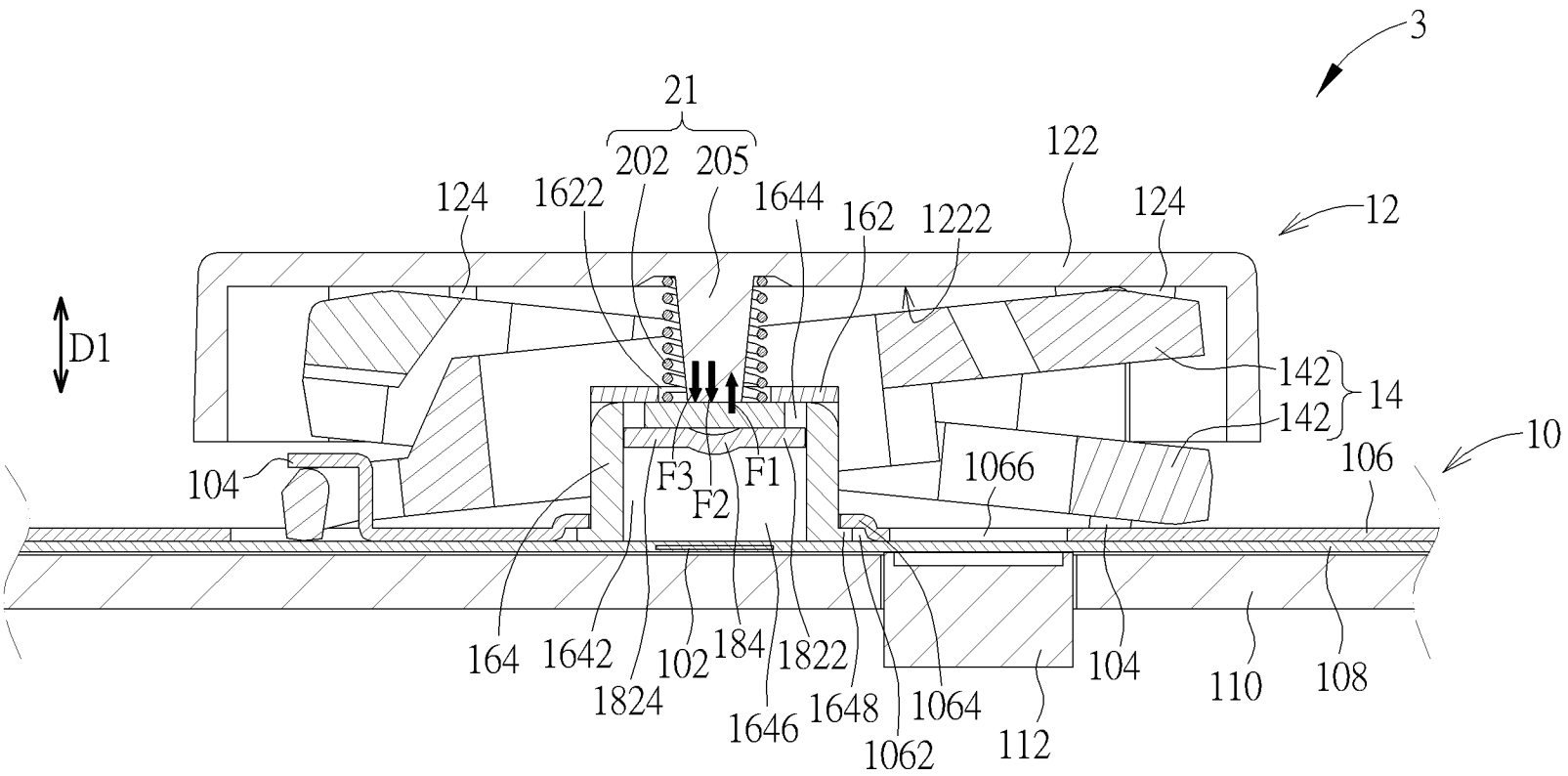
FIG. 6 is a sectional view of a keyswitch according to another embodiment.

In the above-mentioned embodiment, during an operation of the user pressing the keycap 12 to trigger the switch 102 (i.e. the keycap 12 moves to the pressed position, as shown by FIG. 5) and then releasing the keycap 12 so that the keycap 12 return back to its original position (i.e. the keycap 12 moves to the un-pressed position, as shown by FIG. 3), the guiding post 204 does not directly contact the movable part 18 throughout; that is, the keycap 12 exerts force on the movable part 18 only through the spring 202 to move the movable part 18. Furthermore, if the positioning of the spring 202 by itself and the operation stability of the spring 202 is sufficient, the guiding post 204 can be omitted; that is, the force transmission part 20 is a spring 202. However, the invention is not limited thereto. For example, a keyswitch 3 shown by FIG. 6 is substantially the same as the keyswitch 1 in structure; therefore, the keyswitch 3 continues to use the notations of the keyswitch 1 for simplification of the descriptions about the keyswitch 3. In addition to the following descriptions, for other descriptions about the components of the keyswitch 3, please refer to the relevant descriptions about the components notated in the same names in the keyswitch 1, which will not be described in addition. A difference between the keyswitch 3 and the keyswitch 1 is that the extension length of the guiding post 205 of the force transmission part 21 of the keyswitch 3 from the bottom surface 1222 is longer (than that of the guiding post 204 of the keyswitch 1). After the user starts to press the keycap 12 to move toward the base 10, the guiding post 205 will abut against the movable part 18 before the restoring force F2 reaches the maximum of the magnetic attraction force F1. After the guiding post 205 abuts against the movable part 18, if the keycap 12 continues moving toward the base 10, the keycap 12 will exert a pushing force F3 on the movable part 18 through the guiding post 205. Therein, the direction of the pushing force F3 points toward the base 10. At this moment, under an assumption that the movement of the movable part 18 toward the base 10 is a constant speed motion, the resultant force of the pushing force F3 and the restoring force F2 is equal to the magnetic attraction force F1 in principle. Therefore, in FIG. 6, the keycap 12 is located at the intermediate position (which is equivalent to the status of the keyswitch 1 in FIG. 4), and the guiding post 205 abuts against the movable part 18.

It is added that when the keycap 12 just reaches the intermediate position from the un-pressed position (that is, the guiding post 205 just contact the movable part 18), the guiding post 205 does not exert force on the movable part 18 yet, so the pushing force F3 is zero at this moment. As the force exerted on the keycap 12 by the user increases, the force exerted on the movable part 18 through the guiding post 205 by the keycap 12 increases, so that the pushing force F3 also increases. Before the resultant force of the pushing force F3 and the restoring force F2 is in equilibrium with the magnetic attraction force F1, the keycap 12 remains at the intermediate position. Therefore, in the status of the keyswitch 3 shown in FIG. 6, the magnitude of the pushing force F3 may be a value from zero to a difference between the magnetic attraction force F1 and the restoring force F2. In addition, as the second magnetic portion 182 of the movable part 18 gradually moves away from the first magnetic portion 162 of the fixed part 16, the magnetic attraction force F1 decreases gradually, so that the pushing force F3 or the restoring force F2 decreases. In a case that the restoring force F2 decreases, the guiding post 205 and the movable part 18 are separate so that the pushing force F3 disappears. In other words, in the embodiment shown by FIG. 6, when the keycap 12 moves from the intermediate position to the pressed position, the guiding post 205 may remain abutting against the movable part 18 or gradually depart from the movable part 18, which depends on the variation of the magnetic attraction force F1 and the spring constant of the spring 202 of the force transmission part 21 (or the variation of the restoring force F2). The above determination can be done by an equilibrium analysis of force, which will not be described in addition.

Figure 7:
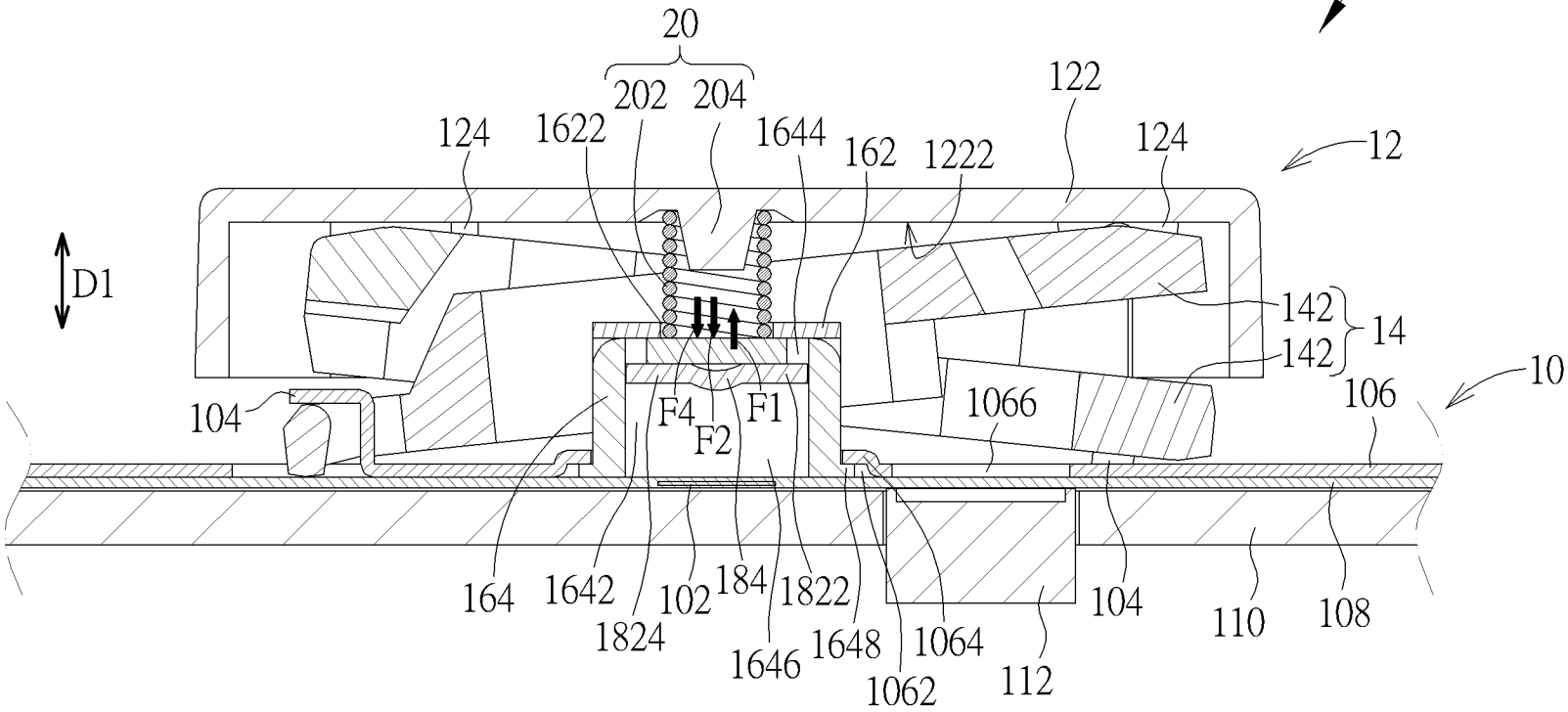
FIG. 7 is a sectional view of a keyswitch according to another embodiment.
Figure 8:
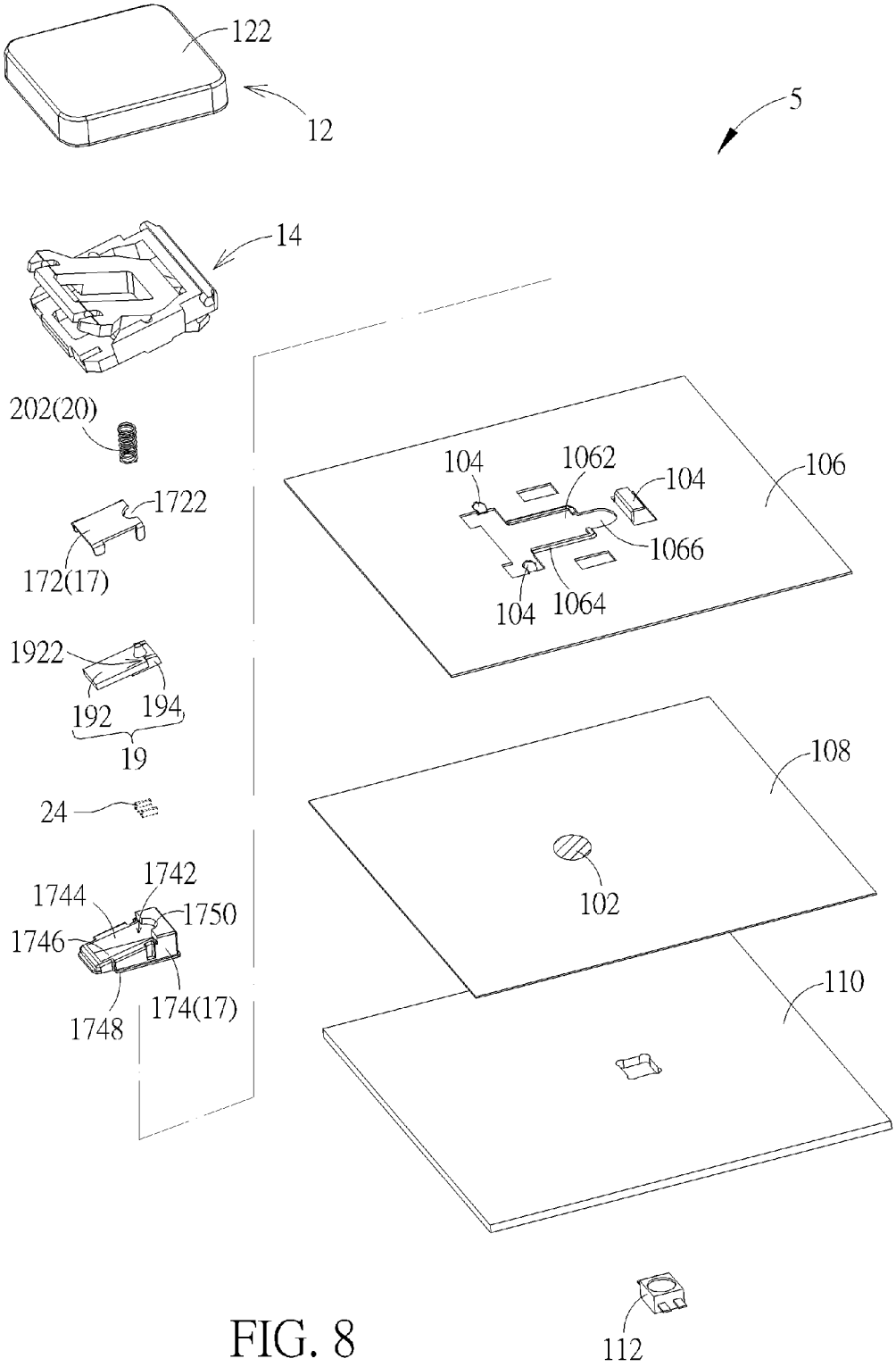
FIG. 8 is an exploded view of a keyswitch of another embodiment according to the invention.

Furthermore, in a pressing operation on the keyswitch 1 (as shown by FIG. 3 to FIG. 5), the spring 202 of the force transmission part 20 is not compressed to be solid throughout and therefore, is capable of being compressed further. However, the invention is not limited thereto. A keyswitch 4 shown by FIG. 7 is substantially the same as the keyswitch 1 in structure; therefore, the keyswitch 4 continues to use the notations of the keyswitch 1 for simplification of the descriptions about the keyswitch 4. In addition to the following descriptions, for other descriptions about the components of the keyswitch 4, please refer to the relevant descriptions about the components notated in the same names in the keyswitch 1, which will not be described in addition. A difference between the keyswitch 4 and the keyswitch 1 is that in the keyswitch 4, after the user starts to press the keycap 12 to move toward the base 10, the spring 202 will be compressed to be solid before the restoring force F2 reaches the maximum of the magnetic attraction force F1; that is, the spring 202 cannot be compressed further and then forms a solid height, so that the spring 202 as a whole shows a rigid body. If the keycap 12 continues moving toward the base 10, the keycap 12 will exert a pushing force F4 on the movable part 18 through the spring 202, which is compressed to be solid, and move the movable part 18 toward the base 10. Therein, the direction of the pushing force F4 points toward the base 10. The movable part 18 suffers the restoring force F2 and the pushing force F4 through the spring 202 (or the movable part 18 suffers a force, which includes the restoring force F2 and the pushing force F4, through the spring 202). At this moment, under an assumption that the movement of the movable part 18 toward the base 10 is a constant speed motion, the resultant force of the pushing force F4 and the restoring force F2 is equal to the magnetic attraction force F1 in principle. Therefore, in FIG. 7, the keycap 12 is located at the intermediate position (which is equivalent to the status of the keyswitch 1 in FIG. 4), and the spring 202 is compressed to be solid.

It is added that when the keycap 12 just reaches the intermediate position from the un-pressed position (that is, the spring 202 is just compressed to be solid), the keycap 12 exerts the restoring force F2 directly on the movable part 18 by exerting force on the spring 202 and compressing the spring 202 but does not exert additional force on the movable part 18 through the spring 202 by the feature that the spring 202 is compressed to be a rigid body, so the pushing force F4 is zero at this moment. As the force exerted on the keycap 12 by the user increases, the force exerted on the movable part 18 through the spring 202 by the keycap 12 increases, so that the pushing force F4 also increases. Before the resultant force of the pushing force F4 and the restoring force F2 is in equilibrium with the magnetic attraction force F1, the keycap 12 remains at the intermediate position. Therefore, in the status of the keyswitch 4 shown in FIG. 7, the magnitude of the pushing force F4 may be a value from zero to a difference between the magnetic attraction force F1 and the restoring force F2. In addition, as the second magnetic portion 182 of the movable part 18 gradually moves away from the first magnetic portion 162 of the fixed part 16, the magnetic attraction force F1 decreases gradually, so that the pushing force F4 or the restoring force F2 decreases. In a case that the restoring force F2 decreases, the spring 202 is no longer compressed to be solid so that the pushing force F4 disappears. In other words, in the embodiment shown by FIG. 7, when the keycap 12 moves from the intermediate position to the pressed position, the spring 202 may remain solid or gradually loose (i.e. the spring 202 is no longer compressed to be solid and gradually restores its resilience), which depends on the variation of the magnetic attraction force F1 and the spring constant of the force spring 202 (or the variation of the restoring force F2). The above determination can be done by an equilibrium analysis of force, which will not be described in addition.

In the above embodiments, the movable part 18 as a whole moves up and down relative to the base 10 in a linear motion; however, the invention is not limited thereto. Please refer to FIG. 8 to FIG. 11, which are relevant drawings about a keyswitch 5 of an embodiment according to the invention. The keyswitch 5 is substantially the same as the keyswitch 1 in structure logic; therefore, the keyswitch 5 continues to use the notations of the keyswitch 1 for simplification of the descriptions about the keyswitch 5. In addition to the following descriptions, for other descriptions about the components of the keyswitch 5, please refer to the relevant descriptions about the components notated in the same names in the keyswitch 1, which will not be described in addition. A difference between the keyswitch 5 and the keyswitch 1 is that a fixed part 17 and a movable part 19 of the keyswitch 5 are structurally different from the fixed part 16 and the movable part 18 of the keyswitch 1. Furthermore, although the structural profiles of the base plate 106 of the keyswitch 5 and the base plate 106 of the keyswitch 1 are partially different from each other, the profile difference is induced by the structural engagement of the base plate 106 with the fixed part 17 in the keyswitch 5, and the structural functions of the base plate 106 of the keyswitch 5 and the base plate 106 of the keyswitch 1 are the same. Therefore, the base plate 106 of the keyswitch 5 still uses the relevant notations of the base plate 106 of the keyswitch 1.

In the embodiment, the fixed part 17 includes a first magnetic portion 172 and a casing 174. The casing 174 is fixed on the base 10 and has an accommodating space 1742 and a first opening 1744 and a second opening 1746 which are connected with the accommodating space 1742. The casing 174 as a whole shows a tubular or annular structure and extends vertically. The first opening 1744 and the second opening 1746 are located at the two opposite ends. The casing 174 is fixed on the base 10 by engaging a flange 1748 disposed at the second opening 1746 with a flange 1064 formed at the first through hole 1062. The movable part 19 is movably disposed in the accommodating space 1742. The spring 202 of the force transmission part 20 extends into the accommodating space 1742 through the first opening 1744 to abut against the movable part 19. In the embodiment, the first magnetic portion 172 is disposed at the first opening 1744 and has a notch 1722. A notch 1750 is formed at the edge of the first opening 1744. The notch 1722 and the notch 1750 are disposed oppositely to form a through hole. The spring 202 extends into the accommodating space 1742 through the through hole and the first opening 1744. In the embodiment, the first magnetic portion 172 is engaged with the edge structure of the first opening 1744 and substantially seals the first opening 1744, so that the accommodating space 1742 is connected with the outside of the casing 174 through the through hole formed by the notches 1722 and 1750 together. Furthermore, in the embodiment, the movable part 19 includes a magnet 192, a soft pad 194, and a trigger portion 196. The soft pad 194 is connected to a side edge 1922 of the magnet 192. The magnet 192 is used as a second magnetic portion 192 of the movable part 19. The trigger portion 196 is disposed on the bottom 1942 of the soft pad 194 and protrudes out toward the base 10. In practice, the trigger portion 196 and the soft pad 194 can be integrated into a single structure, e.g. by an injection molding of rubber. Because of the flexible texture of the soft pad 194, the soft pad 194 can absorb or reduce shaking when the trigger portion 196 impacts the switch 102, which reduces noise produced when the user operates the keyswitch 5.

Figure 9:
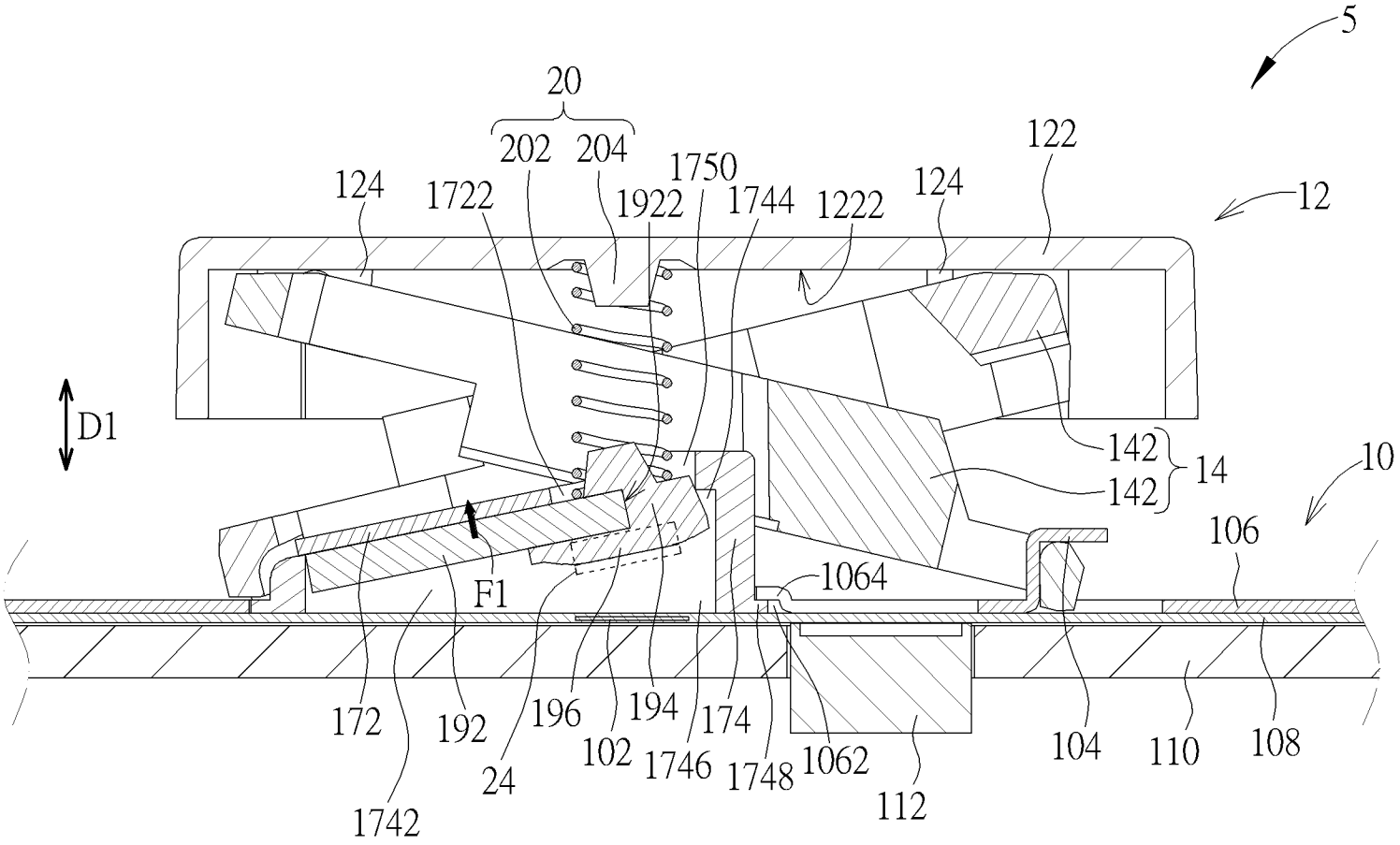
FIG. 9 is a sectional view of the keyswitch in FIG. 8.
Figure 10:
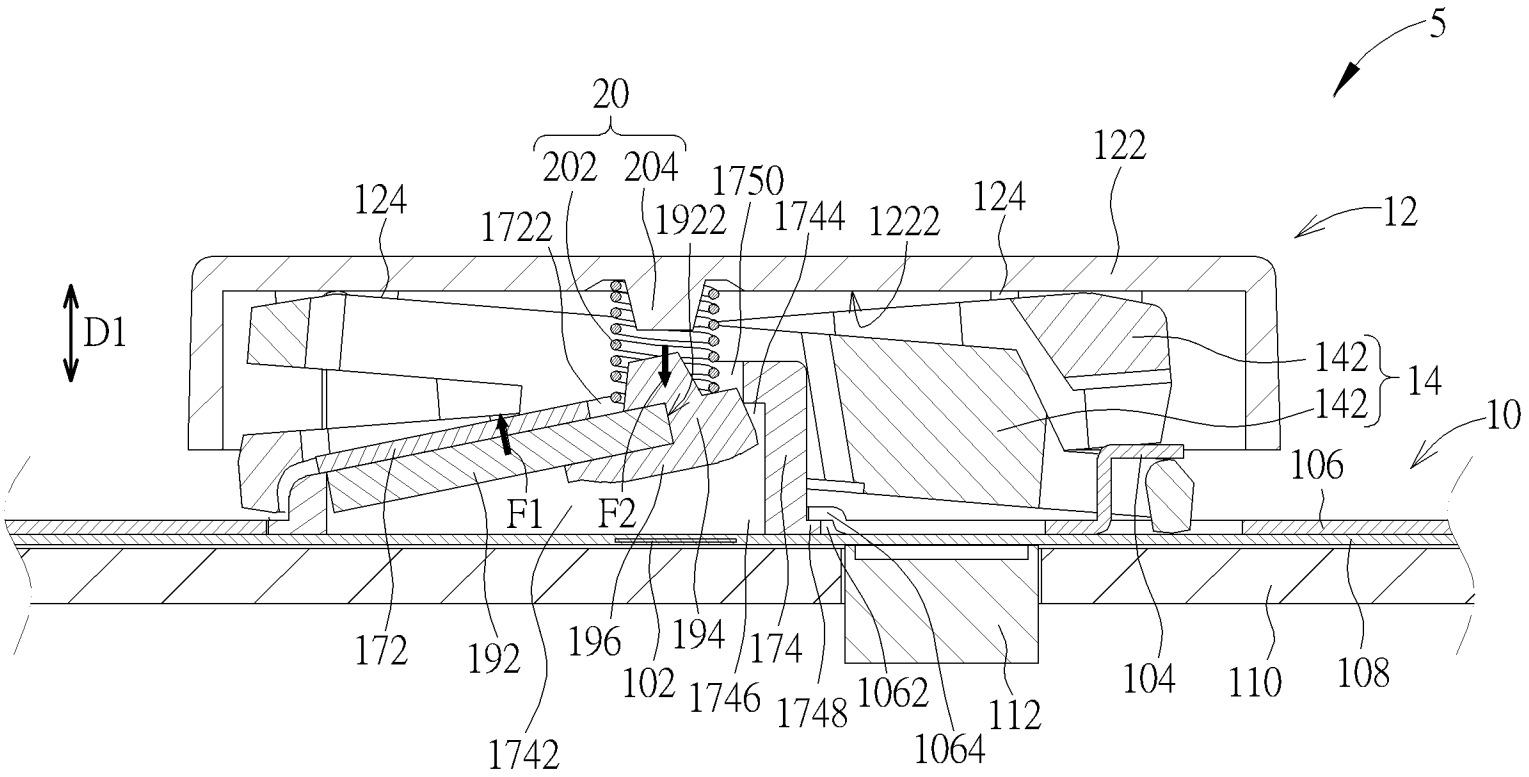
FIG. 10 is a sectional view of the keyswitch in FIG. 8 when a keycap thereof is pressed partially.

Furthermore, the first magnetic portion 172 and the second magnetic portion 192 form a magnetic attraction effect therebetween. The magnetic attraction effect exerts a magnetic attraction force F1 on the movable part 19 (or the second magnetic portion 192). The direction of the magnetic attraction force F1 points toward the first magnetic portion 172. The spring 202 of the force transmission part 20 is connected to and between the cap body 122 and the soft pad 194 of the movable part 19. When the keycap 12 moves from an un-pressed position (as shown by FIG. 9) toward the base 10, the spring 202 is elastically compressed by the keycap 12 and the movable part 19 to exert a restoring force F2 on the soft pad 194 of the movable part 19. The direction of the restoring force F2 points toward the base 10. In practice, the restoring force F2 is equivalent to the restoration force of the compressed spring 202. In the embodiment, the soft pad 194 is located at a side edge 1922 of the magnet 192, so when the restoring force F2 drives the movable part 19 to move toward the base 10, the magnet 192 (or the second magnetic portion 192) rotates toward the base 10. When the keycap 12 is located at a pressed position (as shown by FIG. 11), the trigger portion 196 triggers the switch 102.

Figure 11:
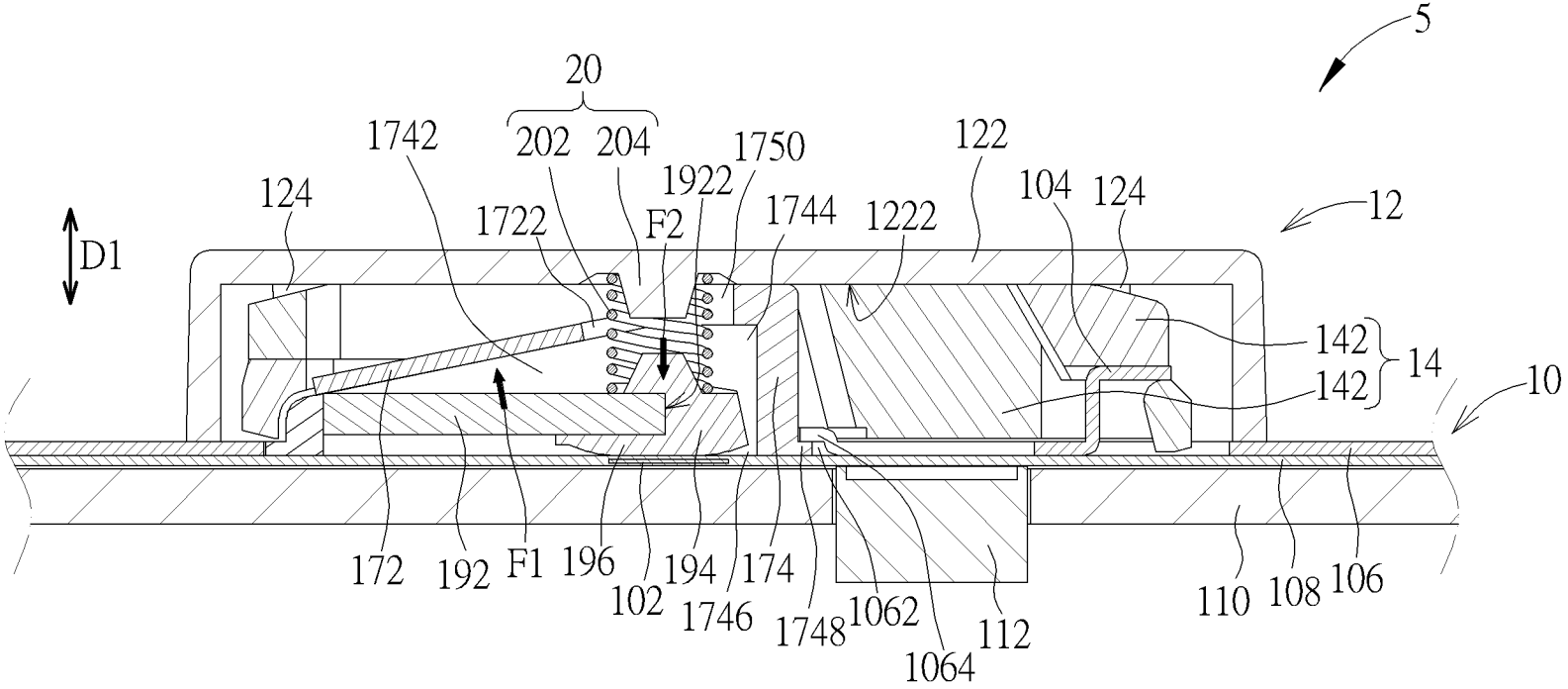
FIG. 11 is a sectional view of the keyswitch in FIG. 8 when the keycap thereof is pressed completely.

In the embodiment, when the keycap 12 is located at the pressed position (as shown by FIG. 11), the spring 202 is not compressed to be solid yet. Therefore, in principle, without consideration to the gravity of the components and the friction produced by relative movements between the components, whether the movable part 19 moves toward the base 10 depends on the resultant force of the magnetic attraction force F1 and the restoring force F2. When the keycap 12 is located at the un-pressed position (as shown by FIG. 9), the spring 202 is not compressed or the compression deformation of the spring 202 reaches a minimum, so the magnitude of the restoring force F2 is zero or reaches a minimum. In FIG. 9, the restoring force F2 is assumed to be zero and is not shown in the figure accordingly. At this moment, the magnetic attraction force F1 is larger than the restoring force F2. The resultant force of the magnetic attraction force F1 and the restoring force F2 makes the movable part 19 remain stationary relative to the base 10. When the keycap 12 is pressed by the user to move from the un-pressed position toward the base 10 to an intermediate position (shown by the location of the keycap 12 in FIG. 10 relative to the base 10, between the un-pressed position and the pressed position), the restoring force F2 increases to be in rotation equilibrium with the magnetic attraction force F1 as the keycap 12 moves; that is, the restoring force F2 overcomes the constraint of the magnetic attraction force F1 on the rotation movement of the movable part 19 relative to the base 10. Therefore, if the keycap 12 proceeds with moving toward the base 10 (e.g. by the user continuing pressing the keycap 12), the keycap 12 moves the movable part 19 toward the base 10 through the spring 202; therein, the magnet 192 (or the second magnetic portion 192) rotates toward the base 10. Therefore, the intermediate position can be designed to be a position where the base 10 is located when the movable part 19 starts moving toward the base 10. Afterward, when the keycap 12 continues moving from the intermediate position to the pressed position, the trigger portion 196 triggers the switch 102, as shown by FIG. 11.

Furthermore, during the movement of the keycap 12 from the intermediate position to the pressed position, the magnitude of the magnetic attraction force F1 decreases as the second magnetic portion 192 of the movable part 19 moves away from the first magnetic portion 172 of the fixed part 17; in principle, the magnitude of the restoring force F2 also decreases. In the embodiment, when the keycap 12 is located between the un-pressed position and the intermediate position, the distance between the first magnetic portion 172 and the second magnetic portion 192 reaches a minimum, and the magnetic attraction force F1 reaches a maximum. Therefore, for an operation of the user pressing the keycap 12 to trigger the switch 102, during the movement of the keycap 12 from the un-pressed position to the intermediate position, the magnitude of the restoring force F2 gradually increases from its minimum (i.e. when the keycap 12 is located at the un-pressed position). During the movement of the keycap 12 from the intermediate position to the pressed position, the restoring force F2 gradually decreases as the magnetic attraction force F1 decreases. Therefore, when pressing the keycap 12 to trigger the switch 102, the user can feel a clear peak of the force feedback (i.e. a local maximum formed when the restoring force F2 increases first and then decreases; at the time the keycap 12 is located at the intermediate position) and also can feel a pressing displacement buffer (i.e. the distance between the un-pressed position and the intermediate position) before the force feedback reaches the peak. Therefore, the keyswitch 5 can provide the user with a clear pressing feeling.

Furthermore, when the user's finger moves away from the keycap 12 located at the pressed position, the spring 202 of the force transmission part 20 springs back rapidly. The movable part 19 is driven by the magnetic attraction force F1 to move upward (or the second magnetic portion 192 rotates upward) and simultaneously moves the keycap 12 upward through the spring 202 until the distance between the first magnetic portion 172 and the second magnetic portion 192 reaches the minimum and the keycap 12 returns to the un-pressed position. In addition, the relevant descriptions about the keyswitches 3 and 4, the variants of the keyswitch 1, are also applicable to the keyswitch 5 and will not be repeated in addition.

Figure 12:
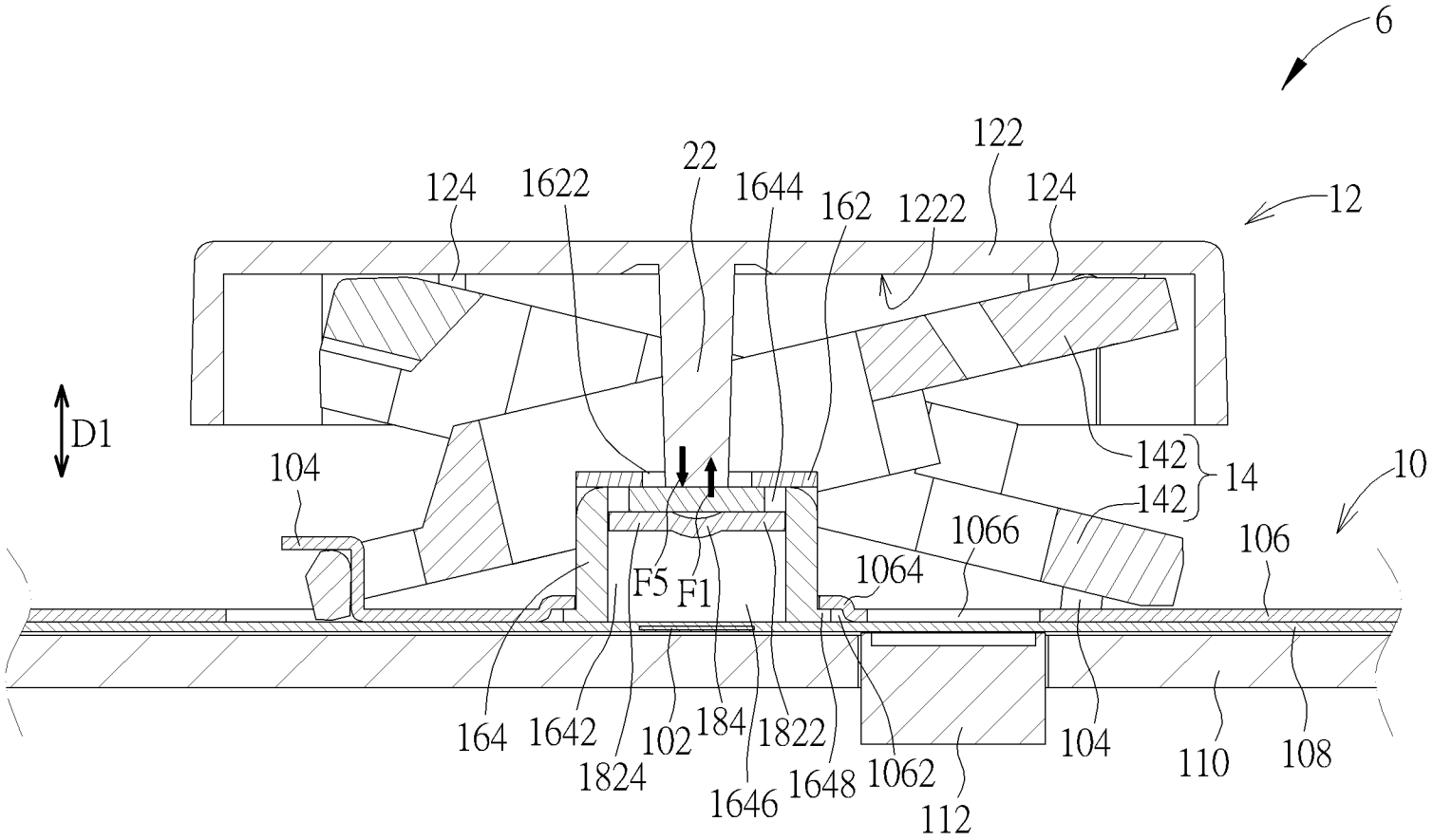
FIG. 12 is a sectional view of a keyswitch of another embodiment according to the invention.

Furthermore, in the above embodiments, the keyswitches 1, 3, 4 and 5 use the spring 202 for transferring force, but the invention is not limited thereto. Please refer to FIG. 12, which is a sectional view of a keyswitch 6 of another embodiment according to the invention. The keyswitch 6 is substantially the same as the keyswitch 1 in structure; therefore, the keyswitch 6 continues to use the notations of the keyswitch 1 for simplification of the descriptions about the keyswitch 6. In addition to the following descriptions, for other descriptions about the components of the keyswitch 6, please refer to the relevant descriptions about the components notated in the same names in the keyswitch 1, which will not be described in addition. A difference between the keyswitch 6 and the keyswitch 1 is that the force transmission part 22 of the keyswitch 6 is a protrusive post extending from the bottom surface 1222 of the cap body 122 toward the movable part 18 and abutting the movable part 18. Therefore, the movement of the keycap 12 relative to the base 10 will be directly transferred to the movable part 18; that is, the keycap 12 and the movable part 18 moved in synchronization. The force transmission part 22 is structurally equivalent to the abovementioned guiding posts 204 and 205. Furthermore, in the embodiment, one end of the force transmission part 22 is fixed on the bottom surface 1222 of the cap body 122, and the other end abuts against the movable part 18. In practice, the force transmission part 22 can be changed to be disposed with one end thereof fixed on the movable part 18 and the other end thereof abutting against the bottom surface 1222 of the cap body 122 or with the two ends fixedly connected to the bottom surface 1222 of the cap body 122 and the movable part 18. For an operation on the keyswitch 6, when the user presses the keycap 12, a force exerted by the user on the keycap 12 is transferred directly through the force transmission part 22 to the movable part 18, which leads to a pushing force F5 exerted on the movable part 18. After the pushing force F5 overcomes the magnetic attraction force F1 (i.e. the pushing force F5 and the magnetic attraction force F1 are in equilibrium), the keycap 12 can move downward, and the movable part 18 moves downward simultaneously. When the keycap 12 is located at the pressed position, the trigger portion 184 triggers the switch 102. Similarly, when the user's finger moves away from the keycap 12 located at the pressed position, the pushing force F5 disappears, so that the movable part 18 is driven by the magnetic attraction force F1 to move upward and the keycap 12 also move upward simultaneously until the distance between the first magnetic portion 162 and the second magnetic portion 182 reaches a minimum and the keycap 12 returns back to the un-pressed position. Thereby, the keyswitch 6 still can provide the user a stable and reliable pressing feeling without a spring.

In the above embodiments, the switch 102 is formed on a membrane circuit board by printing a circuitry thereon, so the trigger portions 184 and 196 can be provided with only a function of downward pressing. However, the invention is not limited thereto. Referring to the structural configurations shown by FIG. 8 and FIG. 9, in a keyswitch of an embodiment, its switch is a pair of contacts. The keyswitch can further include a conductive sheet 24 (shown in dashed lines in FIG. 8 and FIG. 9) disposed between the switch (substantially located at the position of the switch 102 in the figures) and the movable part 19. When the keycap 12 is located at the pressed position, the trigger portion 196 contacts the switch through the conductive sheet 24; that is, the conductive sheet 24 is pressed downward by the trigger portion 196 to short the pair of contacts and therefore the switch is triggered. In the embodiment, the conductive sheet 24 shows a U-shaped structure and clips on the trigger portion 196 (i.e. the bottom of the soft pad 194).

Figure 13:
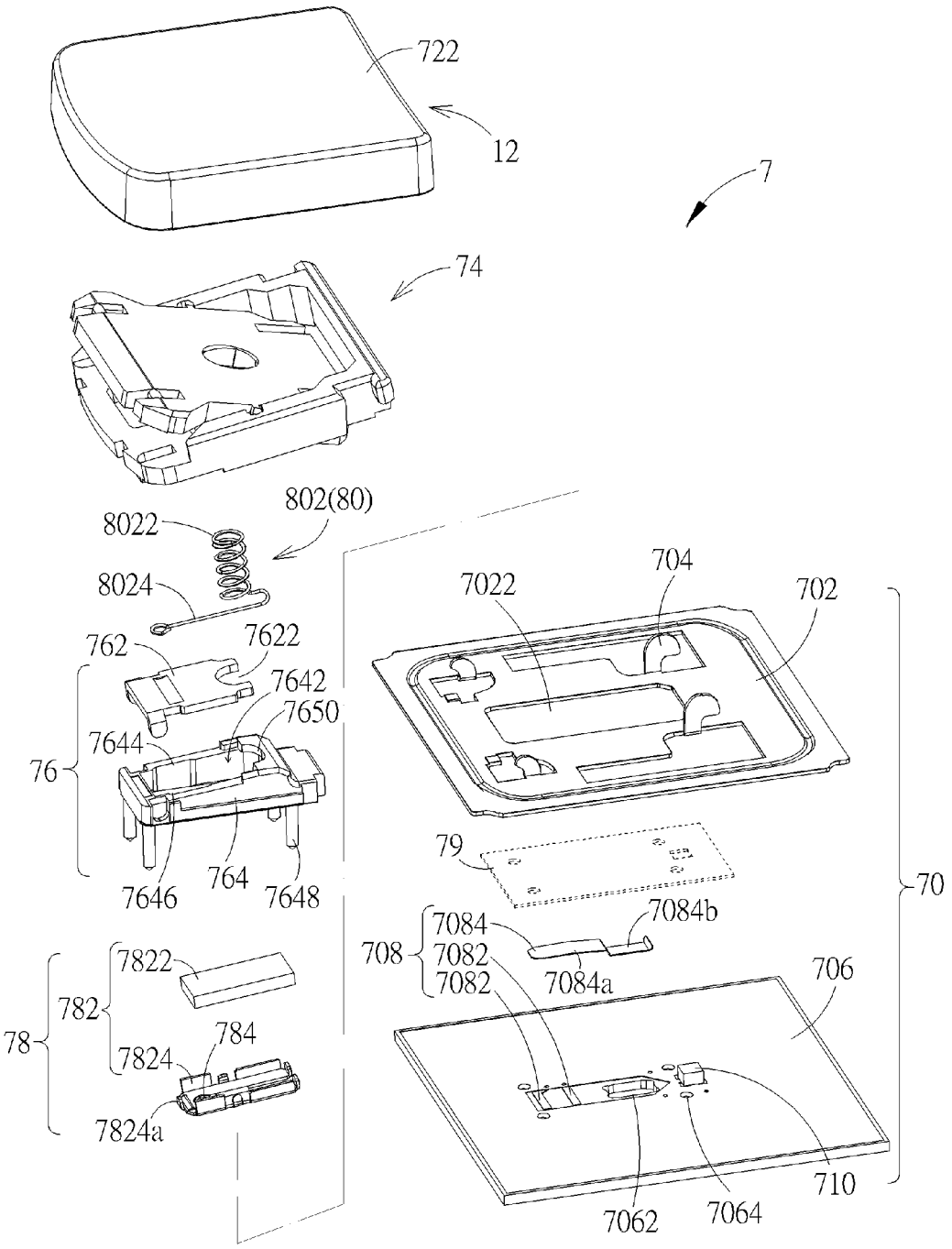
FIG. 13 is an exploded view of a keyswitch of another embodiment according to the invention.

In the above embodiments, the switch 102 is substantially disposed under the force transmission part 20, 21 and 22; however, the invention is not limited thereto. Please refer to FIG. 13 to FIG. 15, which are relevant drawings about a keyswitch 7 of an embodiment according to the invention. The keyswitch 7 is structurally similar to the keyswitch 5; therefore, in addition to the following descriptions, for other descriptions about the components of the keyswitch 7, please refer to the relevant descriptions about the components notated in the same names in the keyswitch 5, which will not be described in addition.

In the embodiment, the keyswitch 7 includes a base 70, a keycap 72, a lift mechanism 74, a fixed part 76, a movable part 78, and a force transmission part 80. The keycap 72 is disposed above the base 70. The lift mechanism 74 is connected to and between the base 70 and the keycap 72, so that the keycap 72 can move parallel to a movement direction Dl (indicated by a line segment with two arrows in FIG. 14 and FIG. 15) relative to the base 70 through the lift mechanism 74 between an un-pressed position (shown by the location of the keycap 72 in FIG. 14 relative to the base 70) and a pressed position (shown by the location of the keycap 72 in FIG. 15 relative to the base 70). The keycap 72 includes a cap body 722 and a connection structure 724 disposed on a bottom surface 7222 of the cap body 122 for being connected with the lift mechanism 74. The base 70 includes a base plate 702, a connection structure 704 disposed on the base plate 702 for being connected with the lift mechanism 74, a circuit board 706 (for example but not limited to a printed circuit board) disposed under the base plate 702, a switch 708, and a lighting part 710 (for example but not limited to an LED) electrically connected onto the circuit board 706. The switch 708 includes two electrode pads 7082 formed on the circuit board 706, and a connecting part 7084 disposed above the two electrode pads 7082. The connecting part 7084 has a conductive portion 7084*a* and a positioned portion 7084*b* extending from the conductive portion 7084*a*. The conductive portion 7084*a* can be pressed down to contact the two electrode pads 7082 so that the two electrode pads 7082 are electrically connected through the conductive portion 7084*a* and therefore the switch 708 is triggered. The connecting part 7084 has a positioned portion 7084*b* extending from the conductive portion 7084*a* and positioned in a positioning hole 7062 formed on the circuit board 706.

The fixed part 76 includes a first magnetic portion 762 and a casing 764. The casing 764 has an accommodating space 7642 and a first opening 7644 and a second opening 7646 which are connected with the accommodating space 7642. The casing 764 is fixed on the base 70 by a plurality of posts 7648 passing through an opening 7022 of the base plate 702 to connect with a plurality of fixing holes 7064 of the circuit board 706 (e.g. by melting the portions of the posts 7648 under the circuit board 706 to form rivets). The first magnetic portion 762 is disposed at the first opening 7644 and has a notch 7622. A notch 7650 is formed at the edge of the first opening 7644. The notch 7622 and the notch 7650 are disposed oppositely to form a through hole.

The movable part 78 is movably disposed in the accommodating space 7642. The movable part 78 includes a second magnetic portion 782 and a trigger portion 784. The second magnetic portion 782 includes a magnet 7822 and a paramagnetic plate 7824 (e.g. a ferroalloy plate), to which the magnet 7822 is attached. In the embodiment, the trigger portion 784 is structurally integrated with the paramagnetic plate 7824 and protrudes downward from the paramagnetic plate 7824. The trigger portion 784 and the switch 708 (or the conductive portion 7084*a* of the connecting part 7084) are disposed oppositely. In addition, in practice, an insulator pad 79 (for example but not limited to a silicon pad, shown in dashed lines in FIG. 13) is used optionally and disposed between the connecting part 7084 and the trigger portion 784. The insulator pad 79 is larger enough to cover the two electrode pads 7082 and the connecting part 7084, so that the switch 708 substantially can be free of dust, water or other materials from outside the insulator pad 79. The insulator pad 79 is also conducive to the disposition of the connecting part 7084.

The force transmission part 80 includes a spring 802 and a guiding post 804 disposed on the bottom surface 7222 of the cap body 122. The spring 802 has a main portion 8022 and a clasping portion 8024 extending from an end of the main portion 8022. The spring 802 is attached to the magnet 7822 by the clasping portion 8024 clasping the magnet 7822. The portion of the clasping portion 8024 under the magnet 7822 is located between the magnet 7822 and the paramagnetic plate 7824. The tail end of the clasping portion 8024 is located between the magnet 7822 and the trigger portion 784. The main portion 8022 of the spring 802 passes through the through hole formed by the notch 7622 and the notch 7650 and sleeves on the guiding post 804 so that the keycap 72 can apply a force to the movable part 78 through the spring 802.

Figure 14:
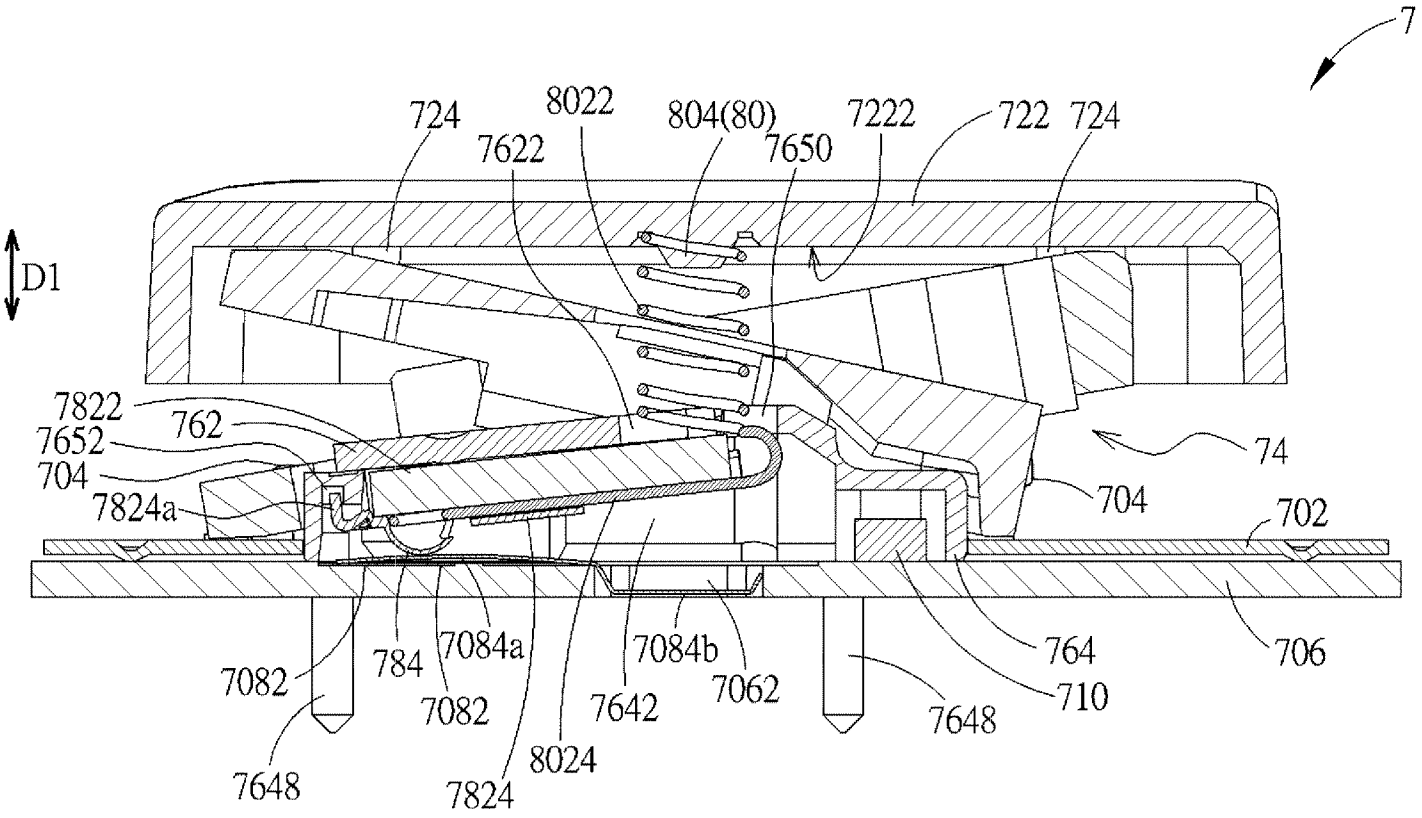
FIG. 14 is a sectional view of the keyswitch in FIG. 13 when a keycap thereof is not pressed yet.
Figure 15:
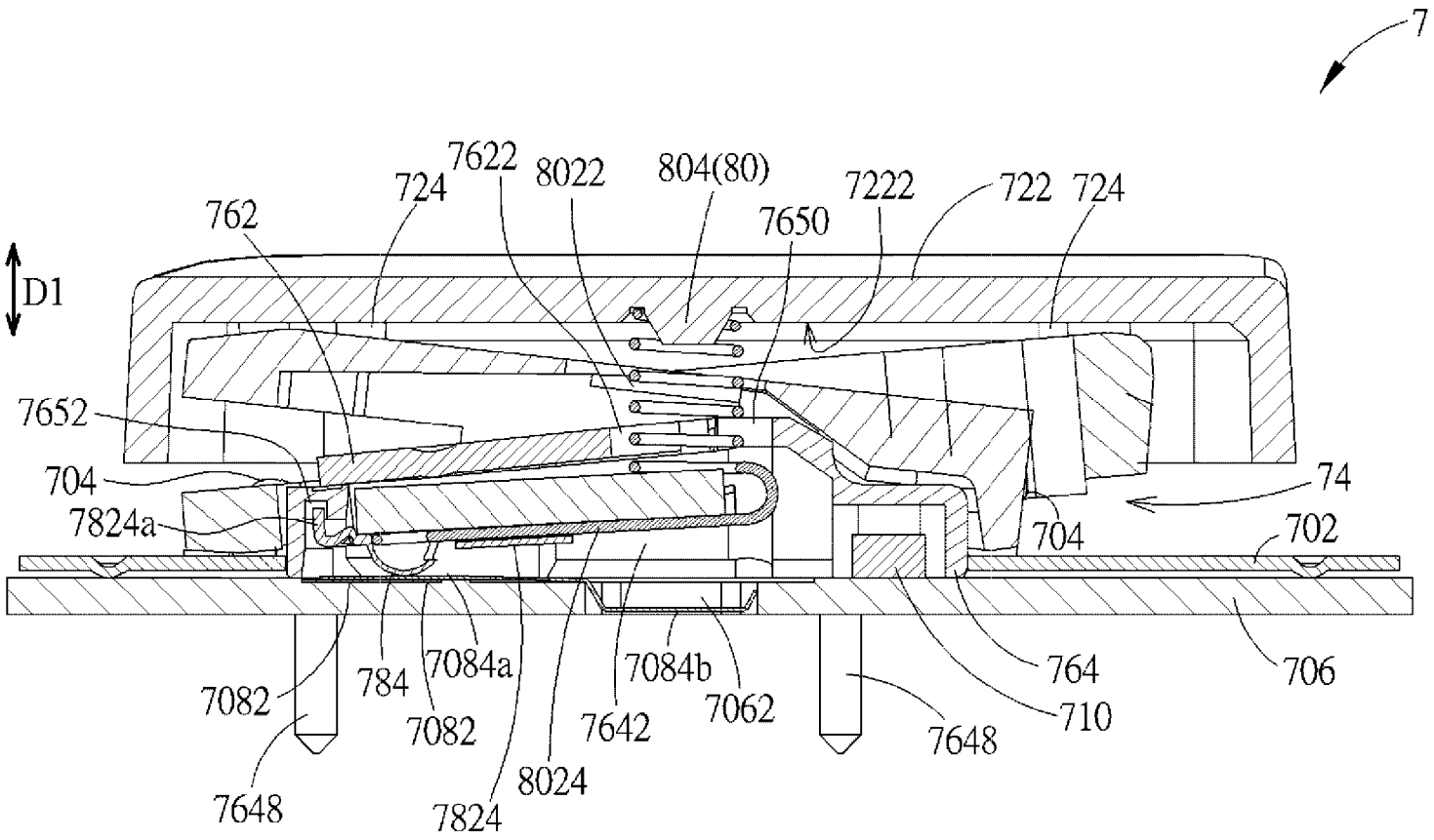
FIG. 15 is a sectional view of the keyswitch in FIG. 13 when the keycap thereof is pressed completely.

In the embodiment, the trigger portion 784 and the switch 708 are not disposed under the main portion 8022, which is used for storing elastic energy and releasing stored elastic energy. A magnetic attraction effect occurs between the first magnetic portion 762 and the second magnetic portion 782. The magnetic attraction effect induces a magnetic attraction force F1 exerted on the movable part 78 (or the second magnetic portion 782). When the keycap 72 moves downward, the main portion 8022 of the spring 802 is compressed to store elastic energy which induces a restoring force F2 applied by the spring 802 to the movable part 78. The magnetic attraction force F1 makes the movable part 78 tend to rotate away from the base 70 while the restoring force F2 makes the movable part 78 tend to rotate toward the base 70. In the views of FIG. 14 and FIG. 15, the movable part 78 is rotatable about its left side, at which the paramagnetic plate 7824 has a hook structure 7824*a*. The casing 764 has a slot 7652 at its left side. The hook structure 7824*a* hooks (or is inserted into) the slot 7652. Therefore, in the embodiment, the engagement of the hook structure 7824*a* and the slot 7652 provide a pivot for the rotation of the movable part 78. The magnetic attraction force F1 and the restoring force F2 are located at the right side of the trigger portion 784 while the pivot is located at the left side of the trigger portion 784. Therefore, when the restoring force F2 is larger than the magnetic attraction force F1, the movable part 78 rotates toward the base 70 about the pivot and then, by a lever principle, the pivot acts as a fulcrum and the movable part 78 acts as a lever so that the trigger portion 784 is forced to move downward to press the conductive portion 7084*a* down to electrically connecting the two electrode pads 7082 (result in triggering the switch 708). Therefore, the switch 708 can be triggered effectively, even under a design that the magnetic attraction force F1 and the restoring force F2 are produced in a small magnitude. Furthermore, the pressed conductive portion 7084*a* also stores elastic energy which is conducive to moving the movable part 78 back to its original position (correspondingly, the keycap 72 returning the un-pressed position) through the trigger portion 784.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch, comprising:

a base, comprising a switch and a connection structure;

a keycap;

a lift mechanism, connected to and between the connection structure and the keycap, the keycap is movable parallel to a movement direction relative to the base through the lift mechanism between an un-pressed position and a pressed position;

a fixed part, disposed fixedly relative to the base between the base and the keycap, the fixed part having a first magnetic portion;

a movable part, disposed movably relative to the base between the base and the fixed part, the movable part having a second magnetic portion and a trigger portion, a magnetic attraction force due to a magnetic attraction effect between the first magnetic portion and the second magnetic portion being exerted on the movable part, a direction of the magnetic attraction force pointing toward the first magnetic portion, the trigger portion and the switch being disposed oppositely, the trigger portion triggering the switch when the keycap is located at the pressed position; and a force transmission part, connected to and between the keycap and the movable part, when the keycap moves from the un-pressed position toward the pressed position, the keycap moving the movable part downward through the force transmission part to make the trigger portion triggers the switch.

2. The keyswitch of claim 1, wherein the force transmission part is a protrusive post extending from the keycap toward the movable part.

3. The keyswitch of claim 1, wherein the force transmission part comprises a spring, an upper end of the spring abuts against the keycap, an lower end of the spring abuts against the movable part, when the keycap moves from the un-pressed position toward the base, the spring is elastically compressed by the keycap and the movable part to exert a restoring force on the movable part, and a direction of the restoring force points toward the base.

4. The keyswitch of claim 3, wherein the force transmission part further comprises a guiding post, and the spring is around the guiding post.

5. The keyswitch of claim 1, wherein the fixed part comprises a casing, the casing is fixed on the base and has an accommodating space and a first opening, the first opening is connected with the accommodating space, the first magnetic portion is fixed on the casing, the movable part is movably in the accommodating space, and the force transmission part extends into the accommodating space through the first opening.

6. The keyswitch of claim 5, wherein the first magnetic portion is at the first opening and has a second through hole, and the force transmission part extends into the accommodating space through the second through hole and the first opening.

7. The keyswitch of claim 5, wherein the base comprises a base plate and a circuit board, the base plate is disposed between the circuit board and the lift mechanism, the base plate has a first through hole, the connection structure is disposed on the base plate, the switch is disposed on the circuit board, the casing has a second opening, the second opening is connected with the accommodating space and is disposed opposite to the first through hole, and the switch is exposed to the accommodating space through the first through hole and the second opening.

8. The keyswitch of claim 5, wherein the movable part comprises a magnet and a paramagnetic plate, the paramagnetic plate is magnetically attached to the magnet and is located between the magnet and the base, the second magnetic portion is formed by the magnet and the paramagnetic plate, and the trigger portion is disposed on the paramagnetic plate and protrudes toward the base.

9. The keyswitch of claim 5, wherein the movable part comprises a magnet and a soft pad, the soft pad is connected to a side edge of the magnet, the magnet is taken as the second magnetic portion, and the trigger portion is disposed on a bottom of the soft pad and protrudes toward the base.

10. The keyswitch of claim 9, wherein when the movable part moves the base, the magnet rotates toward the base.

11. The keyswitch of claim 10, further comprising a conductive sheet disposed between the switch and the movable part, wherein when the keycap is located at the pressed position, the trigger portion triggers the switch through the conductive sheet.

12. The keyswitch of claim 1, an intermediate position between the un-pressed position and the pressed position being defined, wherein the force transmission part comprises a spring connected to and between the keycap and the movable part, and when the keycap is located at the intermediate position, the spring is compressed to be solid.

13. The keyswitch of claim 1, wherein the force transmission part comprises a spring connected to and between the keycap and the movable part, when the keycap moves from the un-pressed position toward the base, the spring is elastically compressed by the keycap and the movable part to exert a restoring force on the movable part, a direction of the restoring force points toward the base, and the magnetic attraction force and the restoring force are parallel to the movement direction.

14. The keyswitch of claim 1, wherein the base comprises a base plate and a circuit board, the base plate is disposed between the circuit board and the lift mechanism, the base plate has a first through hole, the connection structure is disposed on the base plate, and the switch is disposed on the circuit board and is exposed out through the first through hole.

15. The keyswitch of claim 14, wherein the circuit board is a membrane circuit board.

16. The keyswitch of claim 14, wherein the base comprises a lighting part, the lighting part is disposed on the circuit board, the base plate has a window, the lighting part is exposed out through the window, and the lighting part emits light toward the keycap.

17. The keyswitch of claim 1, wherein the first magnetic portion is a paramagnetic part or a magnet, and the second magnetic portion is a magnet or a paramagnetic part correspondingly.

* * * * *